US006352234B1

(12) United States Patent
Liu

(10) Patent No.: US 6,352,234 B1
(45) Date of Patent: Mar. 5, 2002

(54) BABY WALKER POSITIONING FOOT MEMBER

(75) Inventor: Kun-Hei Liu, Taipei (TW)

(73) Assignee: Green Wheel Industrial Co., Ltd., Taipei (TW)

( * ) Notice: Subject to any disclaimer, the term of this patent is extended or adjusted under 35 U.S.C. 154(b) by 0 days.

(21) Appl. No.: 09/758,146

(22) Filed: Jan. 12, 2001

(51) Int. Cl.[7] ..... F16M 3/00; B62B 7/00

(52) U.S. Cl. ..... 248/677; 248/188.1; 280/87.051; 188/5

(58) Field of Search ..... 248/677, 188, 248/188.1, 188.8, 188.5; 280/87.051; 188/5, 20

(56) References Cited

U.S. PATENT DOCUMENTS 2,922,494 A * 1/1960 Clark, Jr. ..... 188/5
3,715,015 A * 2/1973 Morris ..... 188/5
4,699,392 A * 10/1987 Ku ..... 280/87.051
5,366,231 A * 11/1994 Hung ..... 280/87.051
5,586,622 A * 12/1996 Hu ..... 188/20
5,590,892 A * 1/1997 Hu ..... 280/87.051
5,722,503 A * 3/1998 Haller ..... 180/168
5,727,800 A * 3/1998 Liu ..... 280/87.051
5,833,316 A * 11/1998 Hsieh ..... 297/344.21
5,839,706 A * 11/1998 Liu ..... 248/188
5,865,450 A * 2/1999 Ulrich ..... 280/87.051

* cited by examiner

*Primary Examiner*—Anita King
(74) *Attorney, Agent, or Firm*—Varndell & Varndell, PLLC

(57) ABSTRACT

A positioning foot member includes a mounting base fixedly fastened to the bottom side of the wheeled bottom rack of a baby walker, and a holder base coupled to the mounting base and supported on a spring member and alternatively set between a received position for enabling the baby walker to be moved on the floor freely and an extended position to support the baby walker on the floor and to stop the baby walker from movement.

1 Claim, 8 Drawing Sheets

BABY WALKER POSITIONING FOOT MEMBER

BACKGROUND AND SUMMARY OF THE INVENTION

The present invention relates to a baby walker and, more specifically, to a positioning foot member for a baby walker, which has a simple structure and, can easily be set between the extended position to stop the baby walker from movement and the received position for enabling the baby walker to be moved freely on the floor.

Baby walkers with receivable foot member means are commercially available Exemplars of similar designs are seen in U.S. Pat. No. 5,727,800 and U.S. Pat. No. 5,839,706, which are invented by the present inventor. The structure of U.S. Pat. No. 5,727,800 is comprised of a lot of number of parts, and expensive to manufacture. Further, because the structure of U.S. Pat. No. 5,727,800 occupies much installation space, it cannot be used with baby walkers of which the peripheral wall of the wheeled bottom rack is narrow. The structure of U.S. Pat. No. 5,839,706 requires less installation space, however four pieces of foot members must be used and respectively installed in four corners of the wheeled bottom rack. It is complicated and expensive to install four pieces of foot members in four corners of the wheeled bottom rack. Further, operating the foot members at the same time is also complicated.

It is one object of the present invention to provide a positioning foot member for baby walker, which requires less installation space. It is another object of the present invention to provide a positioning foot member for baby walker, which has a simple structure and, is inexpensive to manufacture. It is still another object of the present invention to provide a positioning foot member for baby walker, which can easily be set between the extended position and the received position. According to the present invention, the positioning foot member positioning foot member comprises a mounting base fixedly fastened to the bottom side of the wheeled bottom rack of a baby walker, and a holder base coupled to the mounting base and supported on a spring member and alternatively set between a received position for enabling the baby walker to be moved on the floor freely and an extended position to support the baby walker on the floor and to stop the baby walker from movement. When changing the position of the positioning foot member, the holder base is pulled downwards from the mounting base and rotated through an angle to aim a first pair or second pair of plug holes of the holder base at two plug rods of the mounting base, and then the holder base is released from the hand for enabling the first pair or second pair of plug holes of the holder base to be automatically forced into engagement with the plug rods of the mounting base by means of the spring power of the spring member coupled between the holder base and the mounting base.

DETAILED DESCRIPTION OF THE PREFERRED EMBODIMENTS

Figure 5:
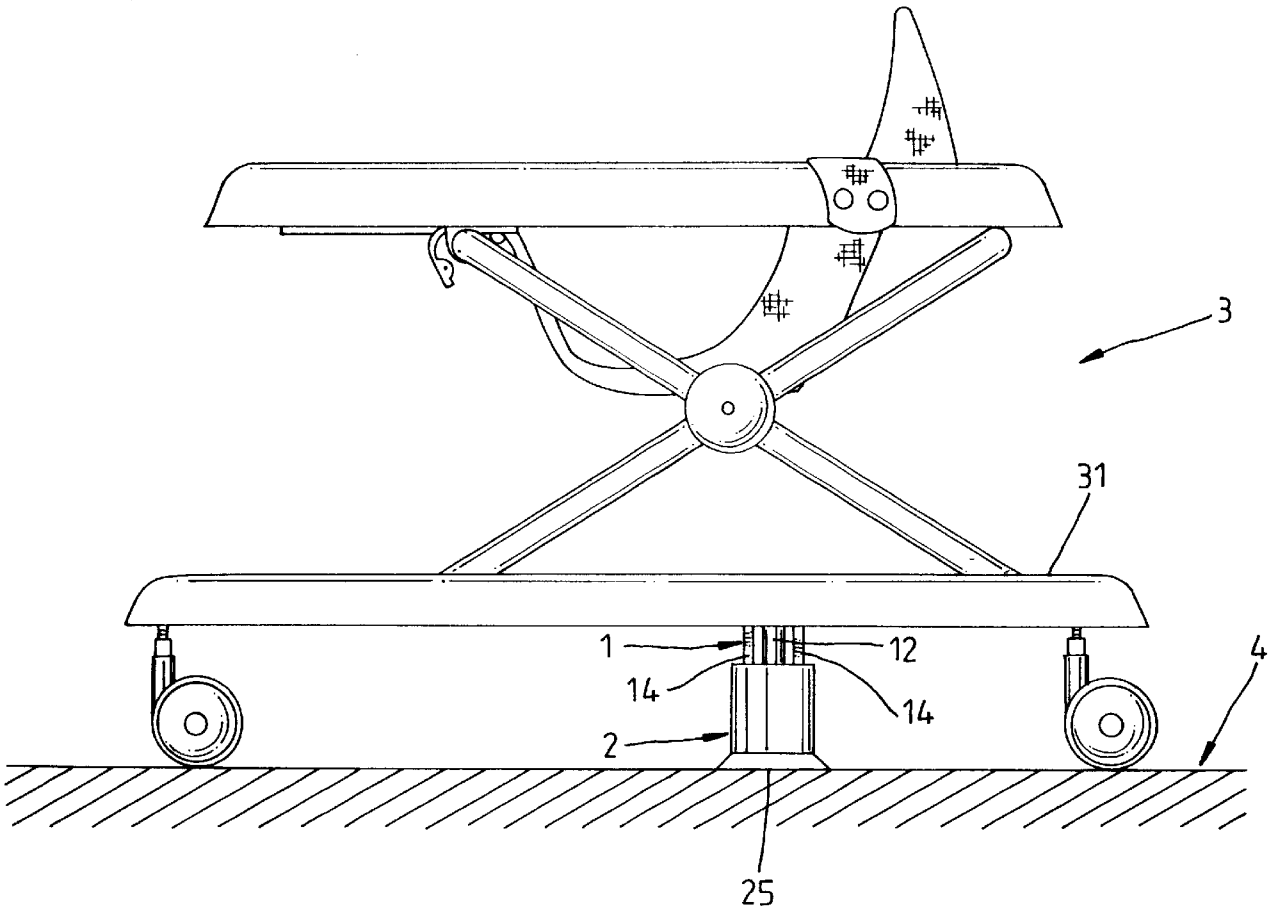
FIG. 5 is an applied view of the present invention, showing the positioning foot member installed in the bottom side of the wheeled bottom rack of a baby walker and set in the extended position
Figure 6:
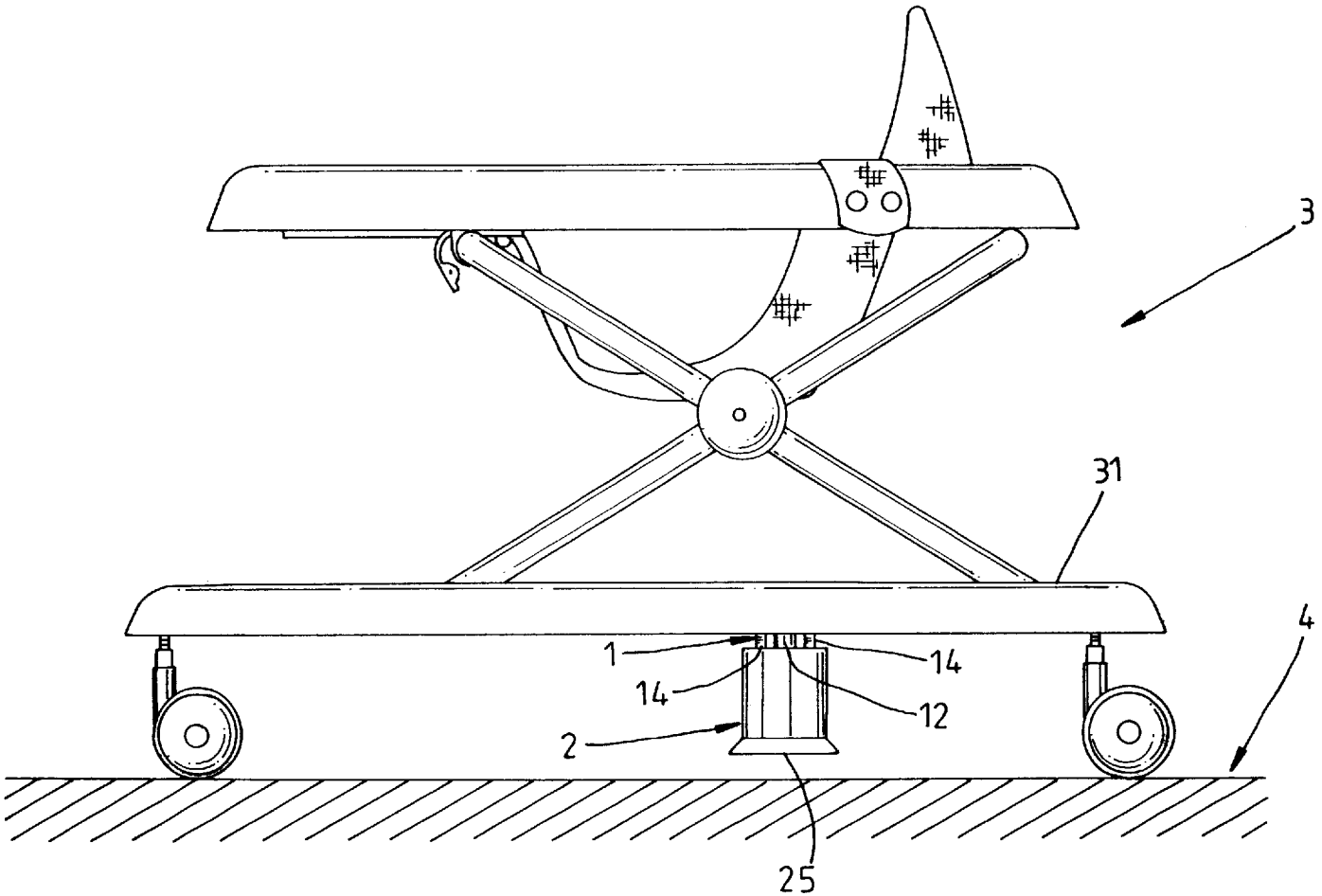
FIG. 6 is an similar to FIG. 5 but showing the positioning foot member set in the received position.
Figure 7:
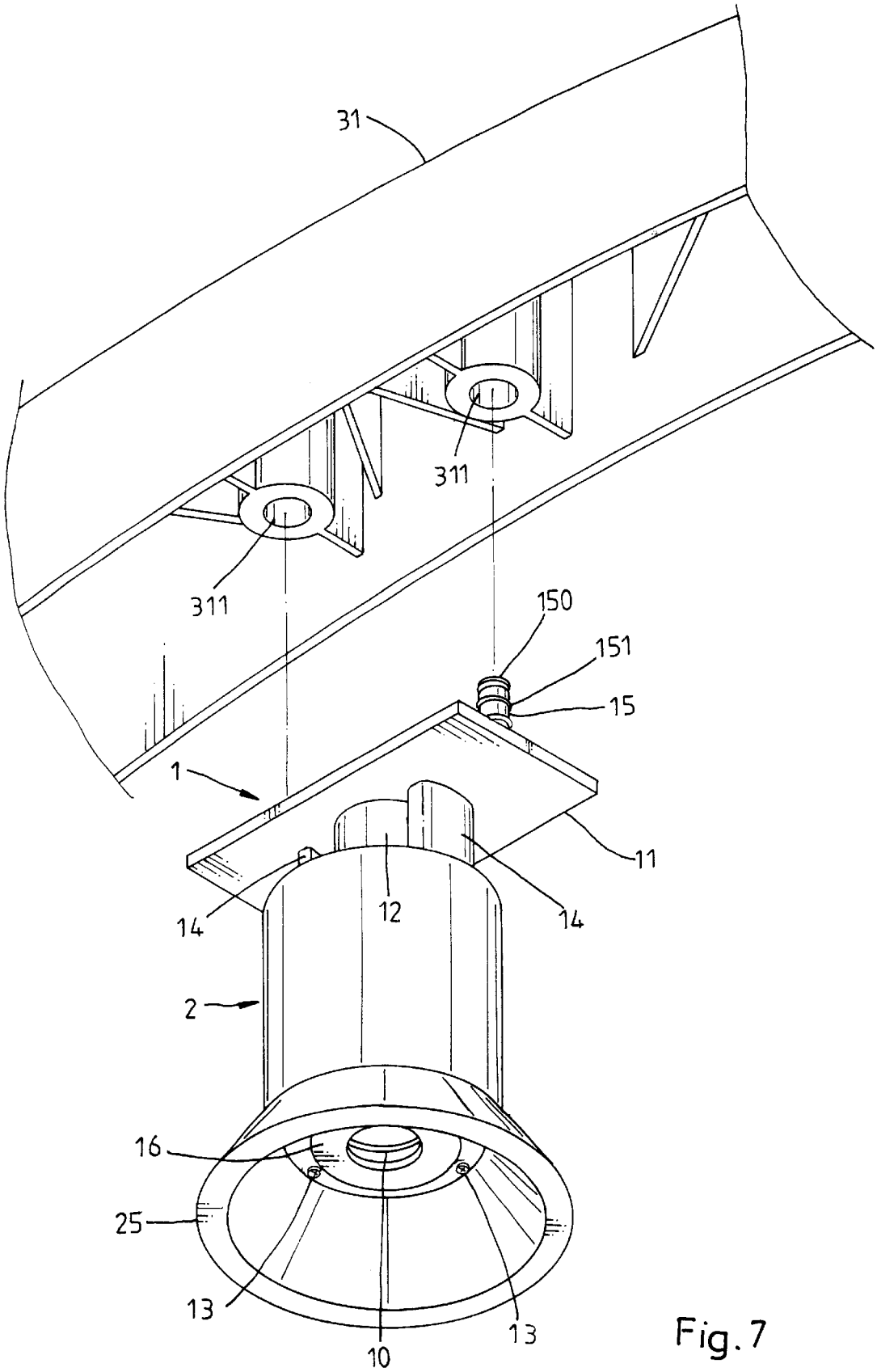
FIG. 7 shows the relationship between the positioning foot member and the wheeled bottom rack of a baby walker according to the present invention.
Figure 8:
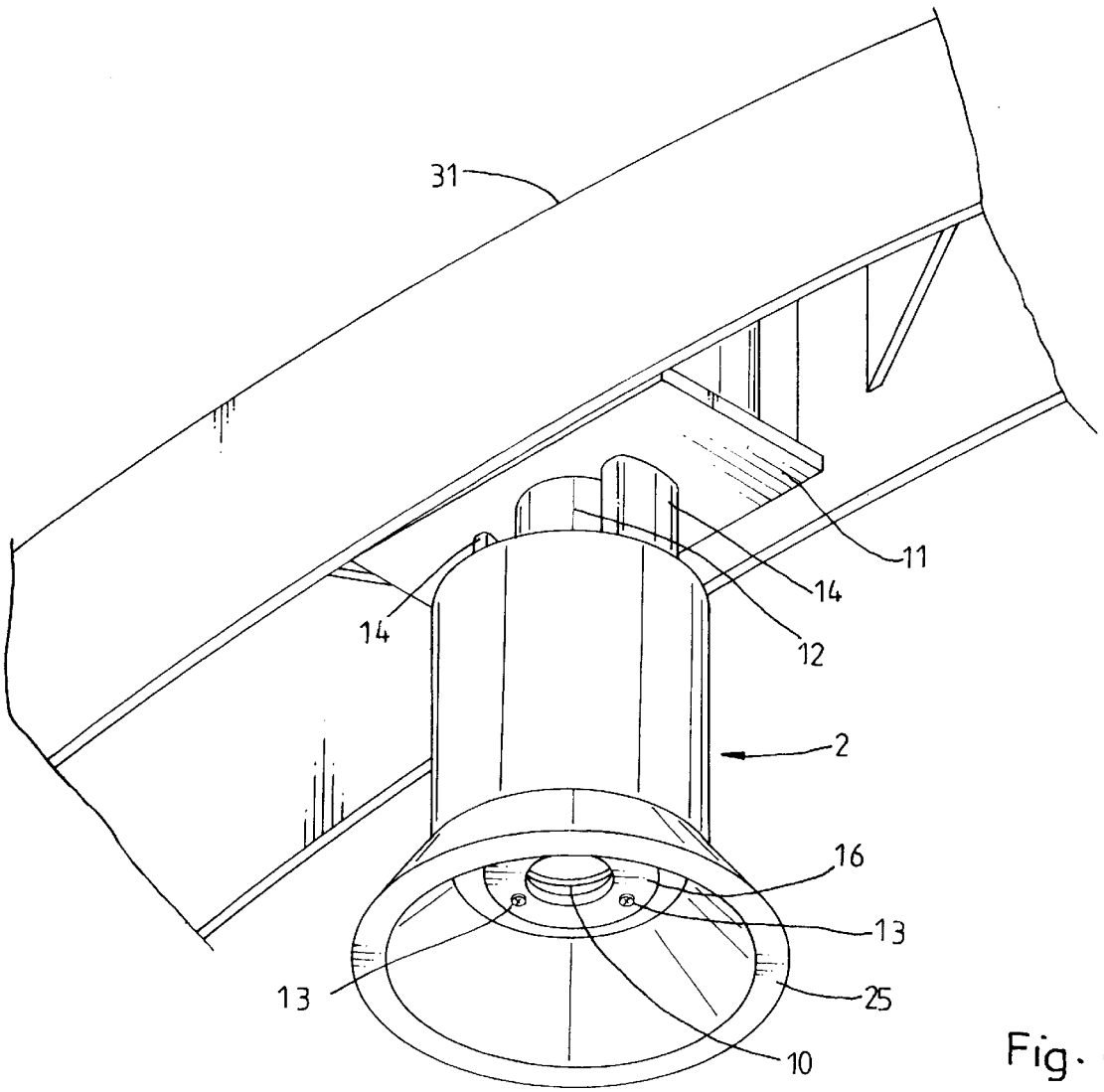
FIG. 8 is an assembly view of FIG. 7.

Referring to FIGS. from 1 through 8, a positioning foot member is provided at the bottom side of the wheeled bottom rack 31 of a baby walker 3, and alternatively set between a received position above the elevation of the wheels of the wheeled bottom rack 31 for enabling the baby walker 3 to be moved on the floor 4 freely (see FIG. 6), and an extended position below the elevation of the wheels of the wheeled bottom rack 31 to support the baby walker 3 on the floor 4 and to stop the baby walker 3 from movement (see FIG. 5). The positioning foot member is comprised of a mounting base 1, a holder base 2, a spring member 19, and a stop plate 16.

Figure 1:
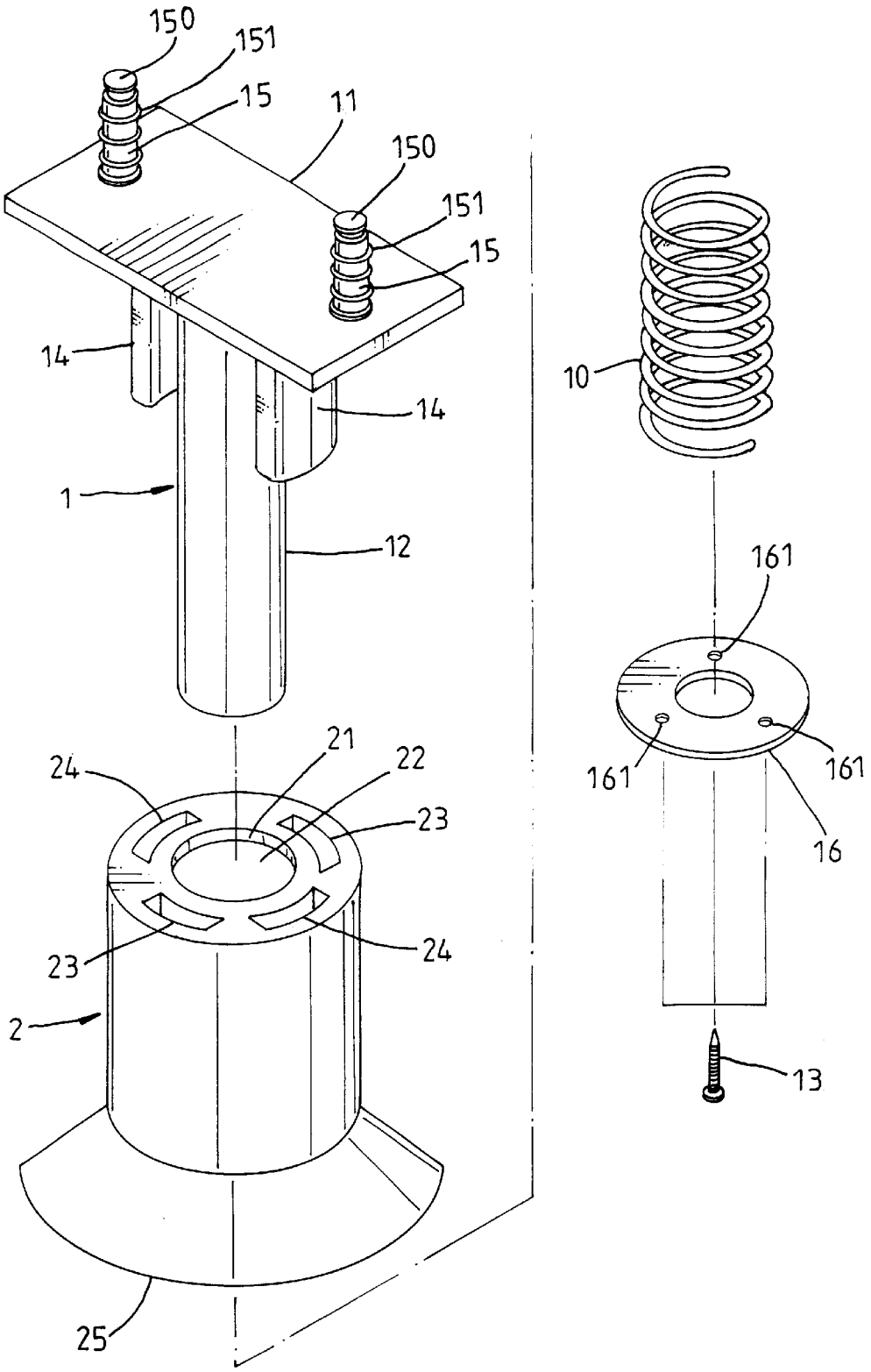
FIG. 1 is an exploded view of a positioning foot member for baby walker according to the present invention.
Figure 2:
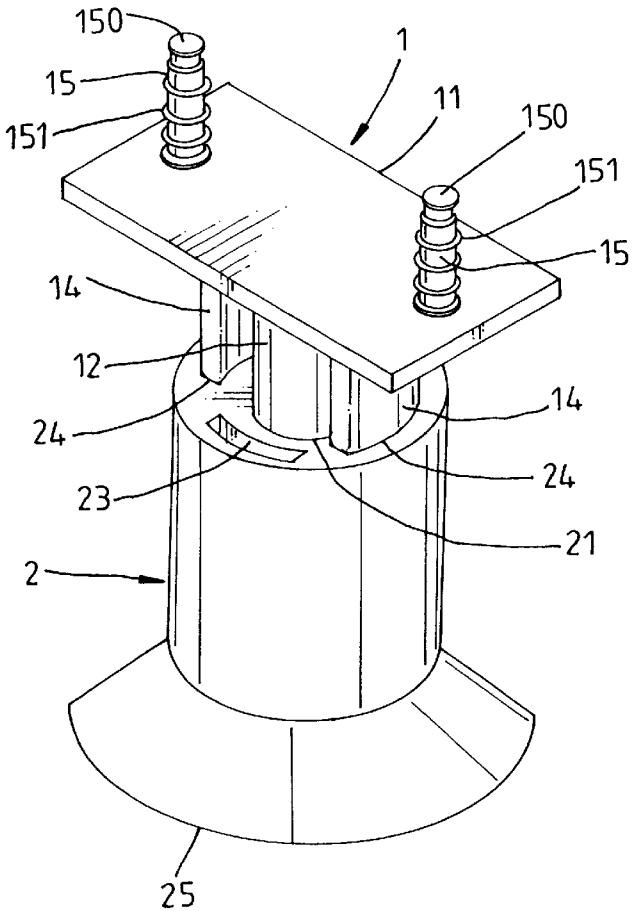
FIG. 2 is an elevational assembly view of the positioning foot member according to the present invention.
Figure 3:
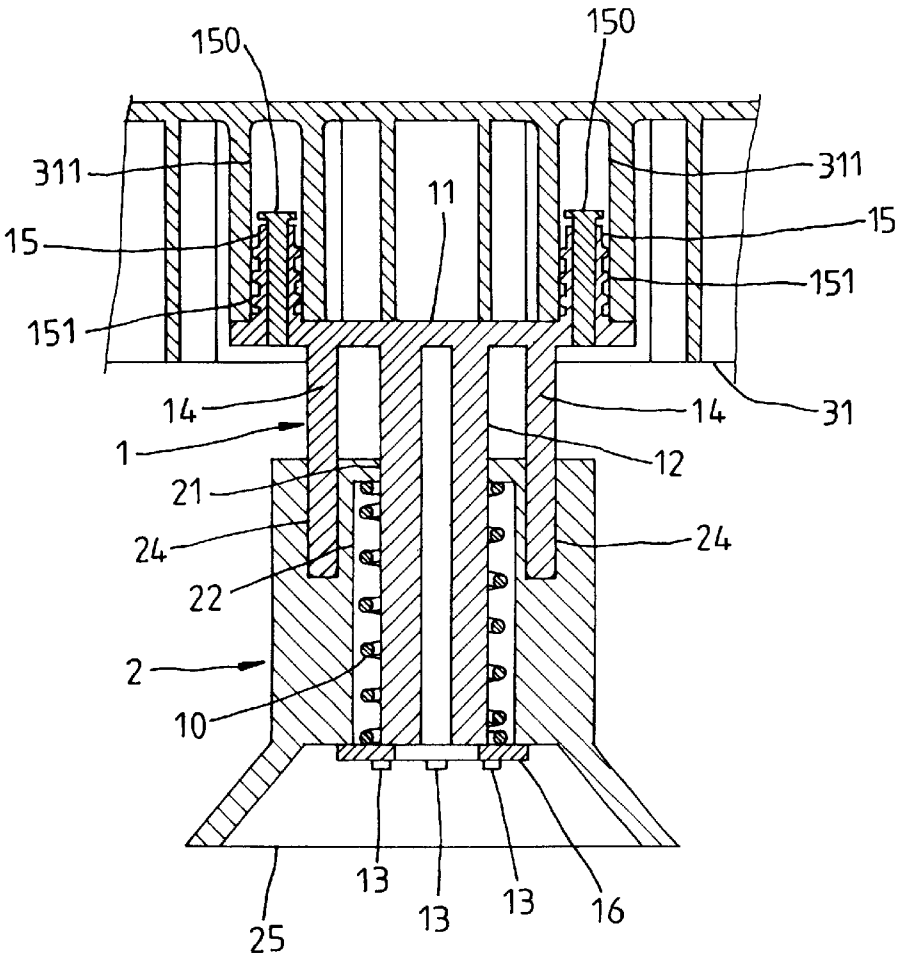
FIG. 3 is a sectional view of the present invention, showing the plug rods of the mounting base plugged into the second plug holes of the holder base.
Figure 4:
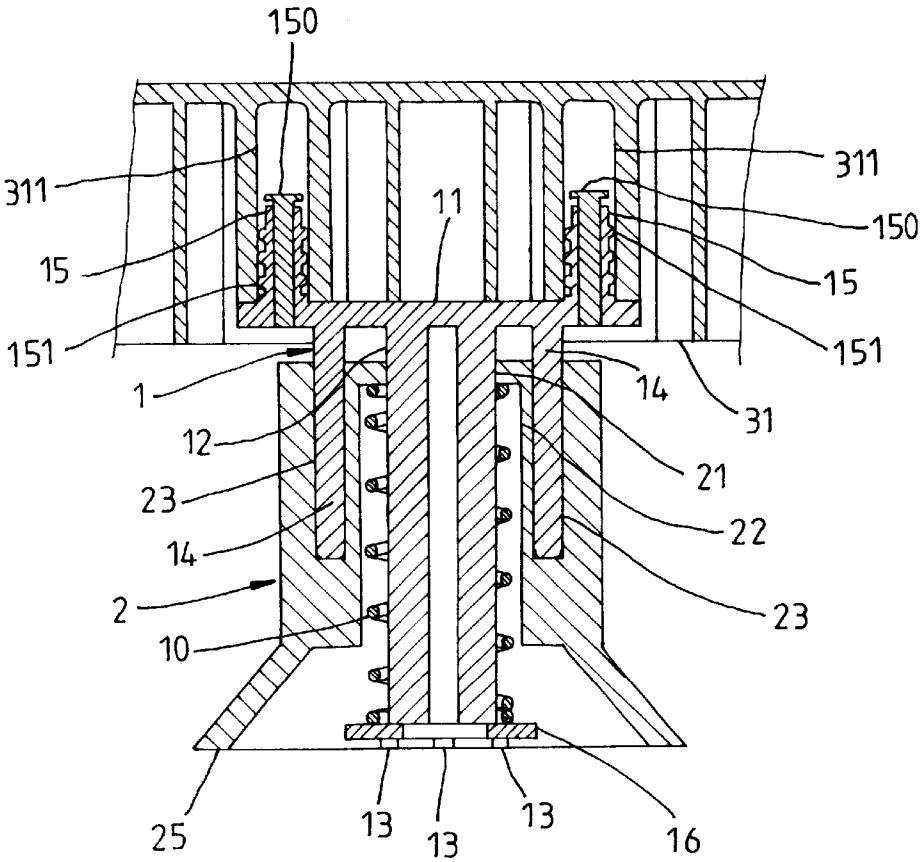
FIG. 4 is another sectional view of the present invention, showing the plug rods of the mounting base plugged into the first plug holes of the holder base.

The holder base 2 comprises a bottom support 25 adapted to support the whole assembly of the positioning foot member and the baby walker 3 on the floor 4, a cylindrical, bottom-open chamber 22, a top center through hole 21 in communication with the cylindrical, bottom-open chamber 22, and two symmetrical pairs of opposite plug holes of different depth, namely, the first pair of plug holes 23 and the second pair of plug holes 24 extended in axial direction and spaced around the top center through hole 21 and the cylindrical, bottom-open chamber 22. The mounting base 1 comprises a flat mounting plate 11, two upright split bolts 15 provided at the top sidewall of the flat mounting plate 11 and fastened to respective locating holes 311 of the wheeled bottom rack 31 of the baby walker (see FIGS. 3 and 4), a vertical shaft 12 downwardly extended from the center of the bottom sidewall of the flat mounting plate 11 and inserted through the top center through hole 21 and cylindrical, bottom-open chamber 22 of the holder base 2, and two vertical plug rods 14 downwardly extended from the bottom sidewall of the flat mounting plate 11 and selectively inserted into one pair of plug holes 23 or 24 of the holder base 2. The stop plate 16 is fixedly fastened to the distal (bottom) end of the vertical shaft 12 of the mounting base 1 and suspended within the bottom support 25 outside the cylindrical, bottom-open chamber 22 of the holder base 2 by screws 13 to limit the distance of upward movement of the mounting base 1 relative to the holder base 2. The stop plate 16 has mounting holes 161 for the installation of the screws 13. The spring member 10 is sleeved onto the vertical shaft 12 of the mounting base 1 and stopped between the stop plate 16 and the bottom surface of the peripheral wall of the top center through hole 21 of the holder base 2 to impart an upward pressure to the mounting base 1 relative to the holder base 2.

When in use, the holder base 2 is pulled downwards relative to the mounting base 1 and disengaged from the constraint of the vertical plug rods 14 of the mounting base 1, and then the holder base 2 is rotated on the vertical shaft 12 of the mounting base 1 to let one pair of plug holes 23 or 24 of the holder base 2 be forced into engagement with the plug rods 14 of the mounting base 1. When plugging the plug rods 14 of the mounting base 1 into the first pair of plug holes 23 (see FIG. 4), the positioning foot member is set in the received position above the elevation of the wheels of the wheeled bottom rack 31 for enabling the baby walker 3 to be moved on the floor 4 freely (see FIG. 6). On the contrary, when plugging the plug rods 14 of the mounting base 1 into the second pair of plug holes 24 (see FIG. 3), the positioning foot member is set in the extended position to support the baby walker 3 on the floor 4 and to stop the baby walker 3 from movement (see FIG. 5).

Further, the split bolts 15 each have threads 151 around the periphery for positive positioning in the respective locating holes 311 of the wheeled bottom rack 31 of the baby walker 3, and fixedly mounted with a rivet 150 for fastening.

While only one embodiment of the present invention has been shown and described, it will be understood that various modifications and changes could be made there unto without departing from the spirit and scope of the invention disclosed.

What is claimed is:

1. A positioning foot member provided at the bottom side of the wheeled bottom rack of a baby walker and alternatively set between a received position for enabling the baby walker to be moved on the floor freely and an extended position to support the baby walker on the floor and to stop the baby walker from movement, the positioning foot member comprising:

a holder base fixedly fastened to the wheeled bottom rack of said baby walker, said holder base comprising a bottom support adapted to support the whole assembly of the positioning foot member and said baby walker on the floor, a cylindrical, bottom-open chamber, a top center through hole in communication with said cylindrical, bottom-open chamber, a first pair of plug holes and a second pair of plug holes extended in axial direction and symmetrically disposed around said top center through hole and said cylindrical, bottom-open chamber;

a mounting base coupled to said mounting base and set between said extended position and said received position, said mounting base comprising a flat mounting plate, two upright split bolts provided at a top sidewall of said flat mounting plate and fastened to respective locating holes of the wheeled bottom rack of said baby walker, a vertical shaft downwardly extended from the center of a bottom sidewall of said flat mounting plate and inserted through the top center through hole and cylindrical, bottom-open chamber of said holder base, and two vertical plug rods downwardly extended from the bottom sidewall of said flat mounting plate and selectively inserted into said first pair of plug holes of said holder base to hold said positioning foot member in said received position, or said second pair of plug holes of said holder base to hold said positioning foot member in said extended position;

a stop plate fixedly fastened to a bottom end of said vertical shaft of said mounting base and suspended within said bottom support outside said cylindrical, bottom-open chamber of said holder base by screws to limit the distance of movement of said mounting base relative to said holder base; and a spring member sleeved onto the vertical shaft of said mounting base and stopped between said stop plate and a peripheral wall of the top center through hole of said holder base to impart an upward pressure to said mounting base relative to said holder base.

* * * * *